US007044277B2

(12) United States Patent
Redzisz

(10) Patent No.: US 7,044,277 B2
(45) Date of Patent: May 16, 2006

(54) COLLAPSIBLE STORAGE CONTAINER

(75) Inventor: Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 67 days.

(21) Appl. No.: 10/178,675

(22) Filed: Jun. 24, 2002

(65) Prior Publication Data

US 2003/0010780 A1 Jan. 16, 2003

Related U.S. Application Data

(63) Continuation-in-part of application No. 10/101,019, filed on Mar. 19, 2002, now abandoned.

(60) Provisional application No. 60/277,132, filed on Mar. 19, 2001.

(51) Int. Cl.
*A45C 7/00* (2006.01)

(52) U.S. Cl. ..... 190/107; 190/109; 190/903

(58) Field of Classification Search ..... 190/107, 190/109, 903; 383/4
See application file for complete search history.

(56) References Cited

U.S. PATENT DOCUMENTS 767,896 A * 8/1904 Lamphier ..... 190/107
1,040,300 A * 10/1912 Fitzgerald ..... 190/107
3,173,465 A * 3/1965 Pastini ..... 150/108
3,818,962 A * 6/1974 Muller-Scherak ..... 383/3
4,984,906 A * 1/1991 Little ..... 383/4
5,332,093 A * 7/1994 Littlepage ..... 206/457
5,445,266 A * 8/1995 Prete et al. ..... 206/320
5,620,069 A * 4/1997 Hurwitz ..... 190/107
5,641,199 A * 6/1997 Bond-Madsen ..... 297/229
5,758,751 A * 6/1998 Charles ..... 190/107
6,039,474 A * 3/2000 DeChant ..... 383/66
6,193,034 B1 * 2/2001 Fournier ..... 190/107
6,681,936 B1 * 1/2004 Godshaw et al. ..... 206/581
2003/0221924 A1 * 12/2003 Tong ..... 190/107

OTHER PUBLICATIONS

Figures 1-5 from Utility Appl. filed Mar. 19, 2002, Ser. No. 10/101,019 which is based from Provisional Appl. filed Mar. 19, 2001, Ser. No. 60/277,132.

* cited by examiner

*Primary Examiner*—Tri M. Mai
(74) *Attorney, Agent, or Firm*—Banner & Witcoff

(57) ABSTRACT

A soft-sided collapsible container or chest is comprised of six panels having a generally rectangular shape which are foldable to form a rectangular parallelepiped container with the sides of the container joined together by a zipper construction provided along inside edges of the two end panels forming the container.

18 Claims, 6 Drawing Sheets

FIG.3
PRIOR ART
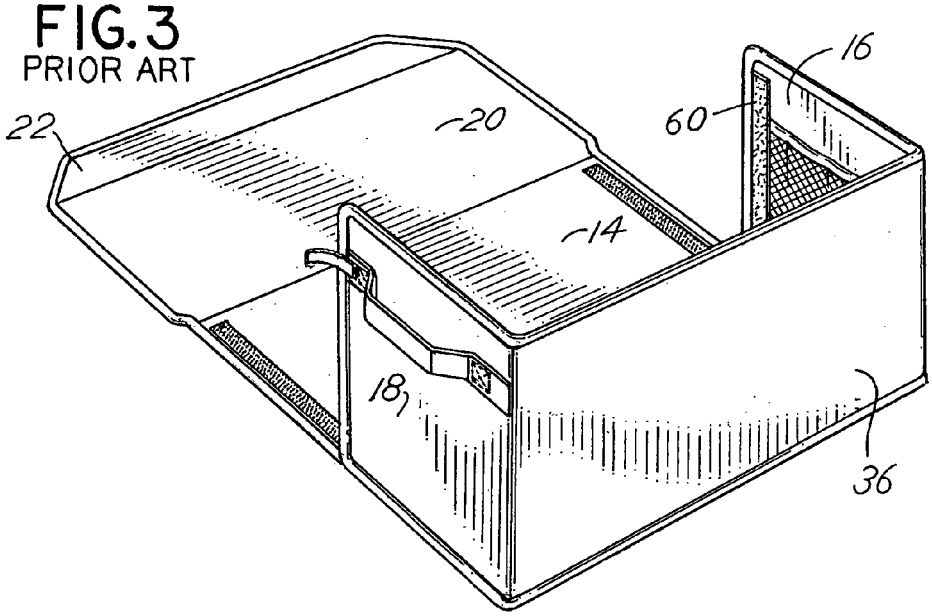
FIG.4
PRIOR ART
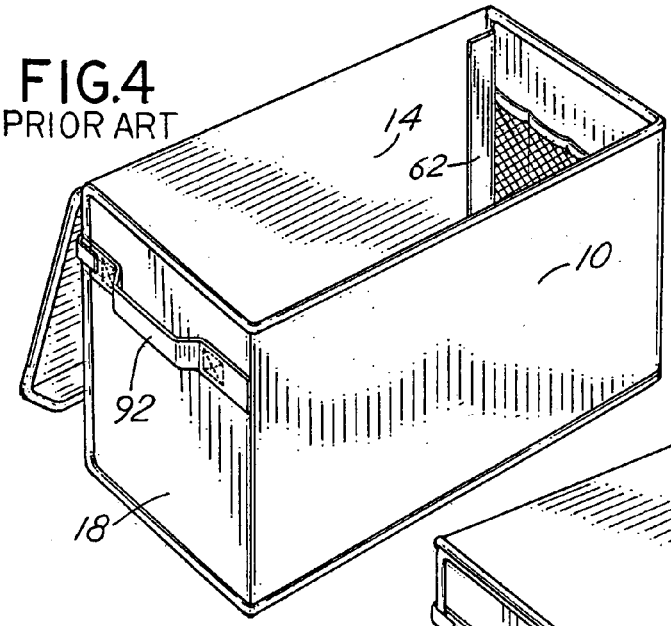
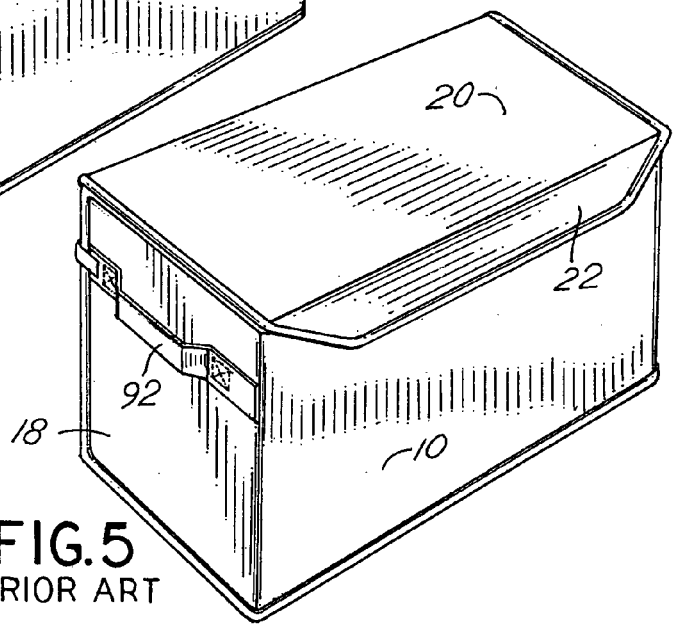
FIG.5
PRIOR ART

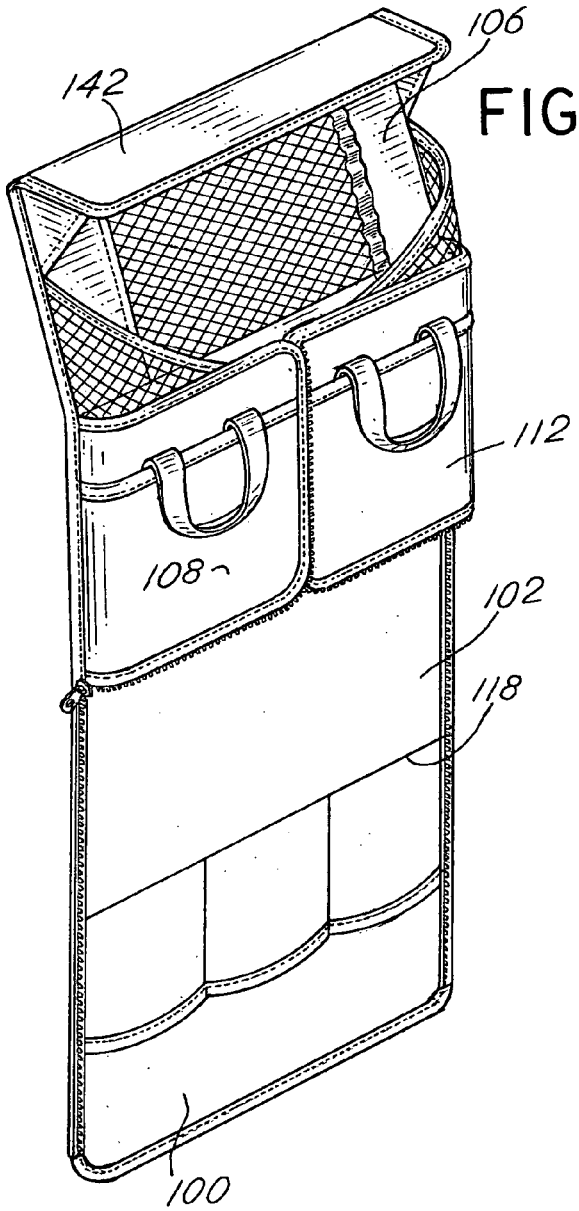
FIG.11
FIG.12
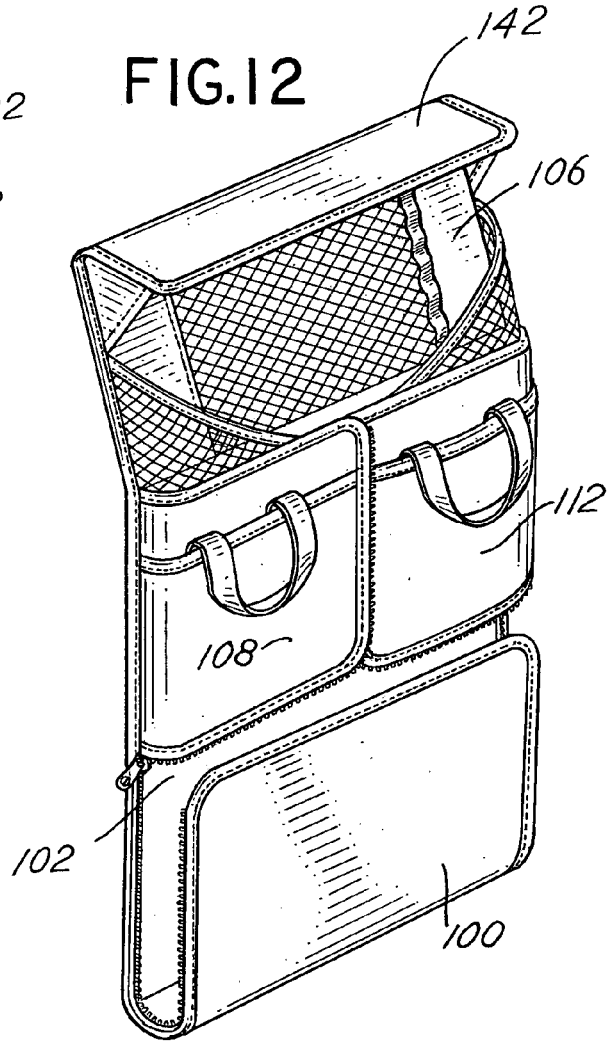

FIG. 13
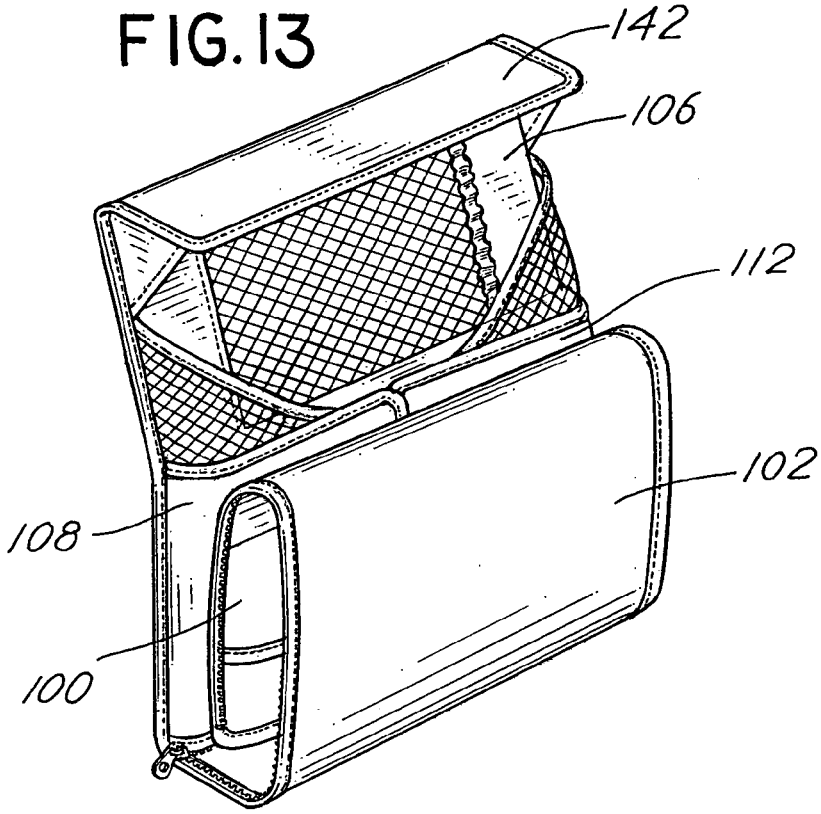
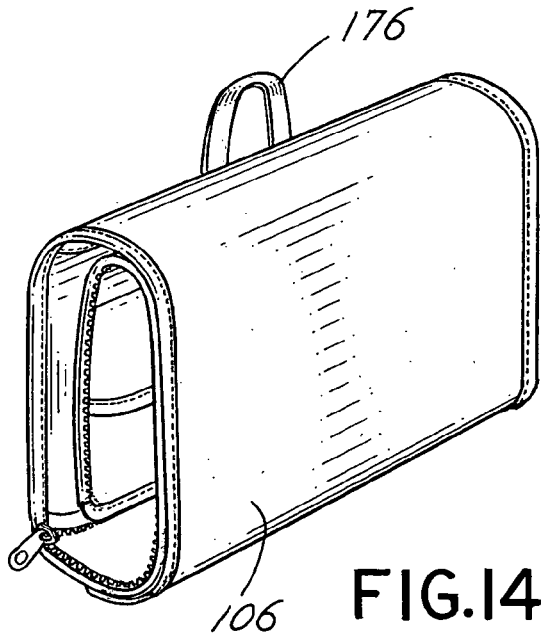
FIG. 14

COLLAPSIBLE STORAGE CONTAINER

This application is a CIP of Ser. No. 10/101,019, filed Mar. 19, 2002, now abandoned, which claims benefit of U.S. Provisional No. 60/277,132, filed Mar. 19, 2001.

BACKGROUND OF THE INVENTION

In a principal aspect, the present invention relates to a storage container or chest and more particularly, a storage container or chest that is collapsible.

Storage of children's toys and articles is often a housekeeping challenge. One solution to this challenge has been the provision of a storage container or storage chest into which toys and other items may be placed or stored. However, a storage chest is often a bulky and difficult item to deploy. Also, in certain circumstances, it may be desirable to quickly remove such a chest from an environment of a room so that the contents thereof may be displayed. Thus, there has developed a need for a storage chest which is collapsible, may be easily assembled and disassembled, which can be made in an attractive form, which is lightweight, which is easily transportable, and which can be easily stored itself when not in use.

SUMMARY OF THE INVENTION

Briefly, the present invention comprises a collapsible storage chest or container which includes a series of six separate, generally rectangular panels that are connected along certain sides to each other and foldable from a flat planar configuration to form a storage container. The chest is thus comprised of a bottom panel, two opposite side panels, a top panel and opposed, spaced end panels. The flat array folds to form a six-sided container with the end panels connectable to the bottom and one side panel by means of a fastening connector mounted along the edges of panels or by means of a zipper incorporated along edges of the panels. The top panel folds over the open top formed by the joined side, end and bottom panels. Outside handles are provided on the end panels. Expandable pockets are optionally included on the inside of the various panels for storage of articles on the inside of the container or chest. Preferably, each of the panels is made from a generally rigid material which is padded so that the chest, although generally rigid in form, will have a cushioned surface to help prevent injury in the event a child or someone accidentally falls onto or against the container or chest.

Thus, it is an object of the invention to provide a collapsible soft-sided container or chest for storage of articles.

It is a further object of the invention to provide a collapsible container or chest which may be formed from a single planar series of panels which fold together to define the container or chest and wherein the panels are interconnected with one another by zippers or other connectors which facilitate ease of assembly and disassembly.

Yet a further object of the invention is to provide an inexpensive, yet rugged and safety-enhanced collapsible container or chest for the storage of articles.

Another object of the invention is to provide a collapsible container or chest which includes a fold-over top to protect the contents of the chest and which further includes handles for facilitating movement of the chest.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is an isometric view illustrating the next step in the assembly of the collapsible prior art chest subsequent to the step depicted in FIG. 2;

FIG. 4 is an isometric view of a further step in the assembly of the embodiment of FIG. 3;

FIG. 5 is an isometric view of the formed or assembled prior art chest;

FIG. 11 is an isometric view of the container of FIG. 10 wherein the fifth and sixth or opposite end panels have been folded entirely over the third or back side rectangular panel;

FIG. 12 is an isometric view of the collapsed container of FIG. 11 wherein the first and second or front side and bottom rectangular panels have been folded one over the other;

FIG. 13 is an isometric view of the container of FIG. 12 wherein the first and second rectangular panels have been folded over the fifth and sixth opposite end panels and the third or back side rectangular panel; and FIG. 14 is an isometric view of the container of FIG. 13 in the fully collapsed or folded condition wherein the top panel or fourth rectangular panel has been folded over the remaining folded panels.

DESCRIPTION OF THE PREFERRED EMBODIMENT

Figure 1:
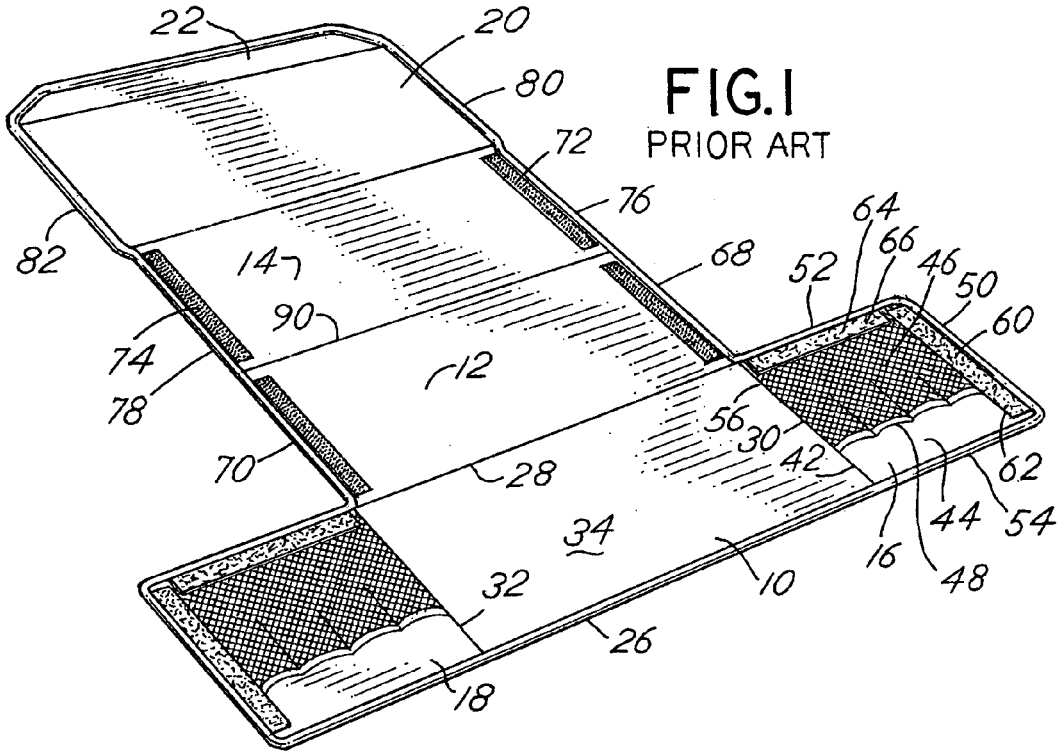
FIG.1 PRIOR ART
FIG. 1 is an isometric view of the component parts forming a prior art chest wherein all of the parts are maintained in a flat, unassembled condition.
Figure 2:
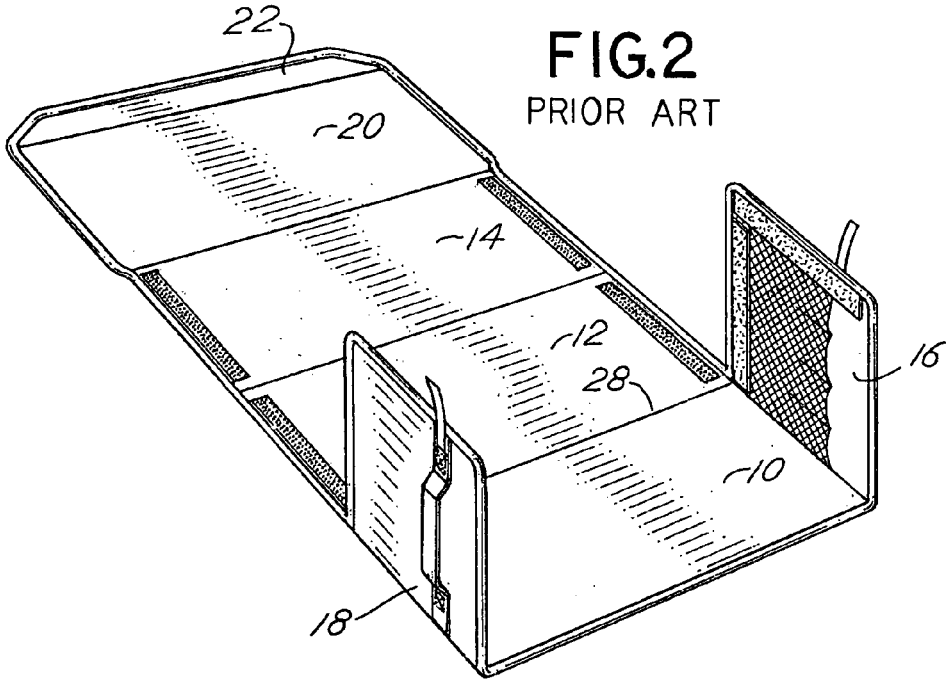
FIG.2 PRIOR ART
FIG. 2 is an isometric view of the component parts forming the prior art chest shown in FIG. 1 wherein those parts have been initially positioned in a first step of assembly.

Referring to the figures, and in particular to FIGS. 1–5, the collapsible prior art chest is comprised of six panels including a first rectangular side panel 10, a second rectangular bottom panel 12, a third rectangular side panel 14, a fifth end panel 16, a sixth, opposite end panel 18 and a fourth rectangular top panel 20 with a fold-over attachment flap 22. Each of the panels 10, 12, 14, 16, 18 and 20 has a rectangular shape. The end panels 16 and 18 have a congruent shape and a square configuration as depicted in FIG. 1. The side panels 10 and 14 and the bottom panel 12 have a rectangular shape. The top panel 20 is also rectangular so as to close the top of the container. The top panel 20 may include dimensions which exceed the rectangular dimensions of the bottom panel 12, particularly the side-to-side dimension so as to fit over and protect the opening defined by the other panels. The top flap 22 is flexibly connected to the top panel 20 so as to fold over and attach to the outside of front side panel 10 as depicted in FIG. 5 and thereby further enclose the container and provide a smooth top surface for stacking capability.

Referring again to FIG. 1, in particular, the first side panel 10 includes a first longitudinal side 26, a parallel longitudinal side 28 spaced therefrom, an end side 30 and a second end side 32 spaced from side 30. The end sides 30 and 32 connect the parallel sides 26 and 28. The first side panel 10 further includes an inside surface 34 and an outside surface 36.

The fifth end panel 16 is, in the embodiment depicted, a square configuration panel which is attached by a flexible hinge 42 to the first side panel 10. The fifth or end panel 16 further includes an inside surface 44. The inside surface 44 includes a flexible mesh pocket 46 attached thereto open along a top edge 48. The fifth end panel 16 further includes an outside edge 50, a bottom side edge 52, a top side edge 54, and an inside edge 56 which is coterminous with the end 30 of the first side panel 10. The bottom side edge 52 of the fifth end panel 16 constitutes an extension of the side 28 of first side panel 10. The top side 54 of fifth end panel 16 extends linearly either straight or at an angle from top side 26 of first side panel 10.

Fifth end panel 16 further includes a loop and/or hook element 60 mounted on a flexible flap 62 along the outside edge 50. In similar fashion, a loop and/or hook 64 mounted on a flexible flap 66 extends along the bottom side edge 52.

The sixth end panel 18 is a mirror image of the fifth end panel 16 and the aforesaid description with respect to those component parts and the arrangements thereof are applicable. The loop and/or hook fasteners 60 and 64 extend preferably entirely along the length of the respective edges 50 and 52 of the fifth end panel 16. Similarly, the loop and/or hook construction of the sixth end panel 18 are so arranged.

The first side panel 10 is connected by a flexible connection or joint along the side 28 to the second or bottom side panel 12. The bottom side panel 12 is rectangular in shape and includes opposite sides 68 and 70 which have a length equal to the length of the bottom edge 52 of the fifth end panel 16. Thus, as depicted in FIG. 3 when folded along the side edge 28, the end panel side 52 will become coterminous with and connectable to, the side 68 of the bottom panel 12 by means of the loop and hook connection depicted.

The third or opposite or back side panel 14 is a panel which has an equal size to the first or front side panel 10 and is in general, a congruent shape. In addition, the third side panel 14 includes a loop and/or hook fastener 72 and a loop and/or hook fastener 74 along side edges 76 and 78, respectively. The loop and/or hook fasteners 72 and 74 are designed to cooperate with the fastener or connecting fastener, 60 mounted on the flap 62 associated with the fifth end panel 16 and the corresponding component part of the sixth end panel 18 as depicted in FIG. 4.

The length of the sides 76 and 78 of third panel 14 is correlated to the length of the side 50 of the fifth end panel 16. The length of the sides 50 and 52 of the fifth end panel 16 is correlated with the length of the sides 68 of second or bottom panel 12 and side 72 of the back side panel 14. Further, the top panel 20 includes sides 80 and 82 whose length is correlated to the length of the side 54 associated with the fifth end panel 16.

FIGS. 1–5 illustrate, in serial order, the steps in the assembly of the chest or container of the prior art. FIG. 1 depicts the chest or container when all of the component parts are laid out in a flat configuration. The junctures between each of the panels defines a flexible hinge.

To assemble the container, the steps illustrated by FIGS. 1–5 are followed. Thus, first the fifth and sixth end panels 16 and 18 are folded (FIG. 2) so that they extend generally perpendicular and upwardly from the first or front side panel 10. Next, as shown in FIG. 3, the first side panel 10 is folded along its side 28 so that the end panels 16, 18 can be connected to the bottom or second panel 12. The loop and hook construction associated with flaps on the end panels 16, 18 permit solid attachment of the end panel 16 and end panel 18 to the bottom panel 12. As a subsequent step illustrated in FIG. 4, the partially assembled panels 10 and 12 are folded once again along a juncture 90 between second and third panels 12 and 14. This defines the enclosure for the container. Thus, an open top container as depicted in FIG. 4 is assembled. Handles such as handle 92 on end panel 18 are provided so that the carrying case or chest may be easily transported.

FIGS. 6 through 14 depict a preferred embodiment of the invention. Referring to FIGS. 6 through 14, the embodiment includes a first rectangular front side panel 100, a second rectangular bottom side panel 102, a third rectangular back side panel 104, and a fourth rectangular top side panel 106. A fifth rectangular end panel 108 is attached flexibly along one of its rectangular sides 110 to a lateral side of the third panel 104. Similarly a sixth end panel 112 is attached along a side or edge 114 by a flexible hinge connection to the opposite lateral side 116 of the third panel 104. In this manner the fifth end panel 108 and the sixth end panel 112 may be folded about the edges or sides 110 and 114 between the position shown in FIG. 10 and the position depicted, for example, in FIG. 12.

The fifth and sixth end panels 108 and 112 are congruent in shape and formed from a generally semi-rigid material, for example, a planar plate of plastic material encapsulated, for example, in fabric. Similarly, all of the panels 100, 102, 104, and 106 are rigid or semi-rigid but include flexible connections therebetween so that they may be folded one with respect to the other. Thus, for example, the first rectangular side panel 100 is joined along a flexible seam or junction 118 to the second rectangular, bottom panel 102.

A zipper fastening mechanism is provided for attachment of the first rectangular side panel 100 as well as the second rectangular bottom side panel 102 to the fifth end panel 108 and sixth end panel 112. Thus a zipper fastener 120 is provided for fastening along a bottom edge 122 of fifth end panel 108 and then a side edge 124 of the fifth end panel 108. The zipper 120 continuously and serially joins the edge 122 with the side edge 126 of the second rectangular panel 102 and the side edge 124 of panel 108 with the side edge 128 of first panel 100. A second zipper 130 provides for similar attachment of the side edges of the second panel 102 and first panel 100 to the sixth end panel 112.

The first rectangular side panel 100, the second rectangular bottom side panel 102, and the third rectangular side panel 104 in combination with the fifth end panel 108 and sixth end panel 112 thus form a five-sided enclosure for storage of toys, etc. The fourth, top side panel 106 may then be folded over the enclosure to protect the contents thereof.

A flexible side gusset 132 connects between a top edge 134 of fifth end panel 108 and side edge 136 of the fourth top rectangular panel 106. The side gusset 132 thus limits the flexure or amount of opening of the fourth top panel 106. A similar side gusset 140 is provided for connecting the sixth end panel 112 and the fourth top side panel 106. The top side panel 106 further includes a flap extension 142 which preferably includes a hook and/or fastening mechanism to maintain the collapsible container construction in the closed condition as depicted in FIG. 14.

Figure 10:
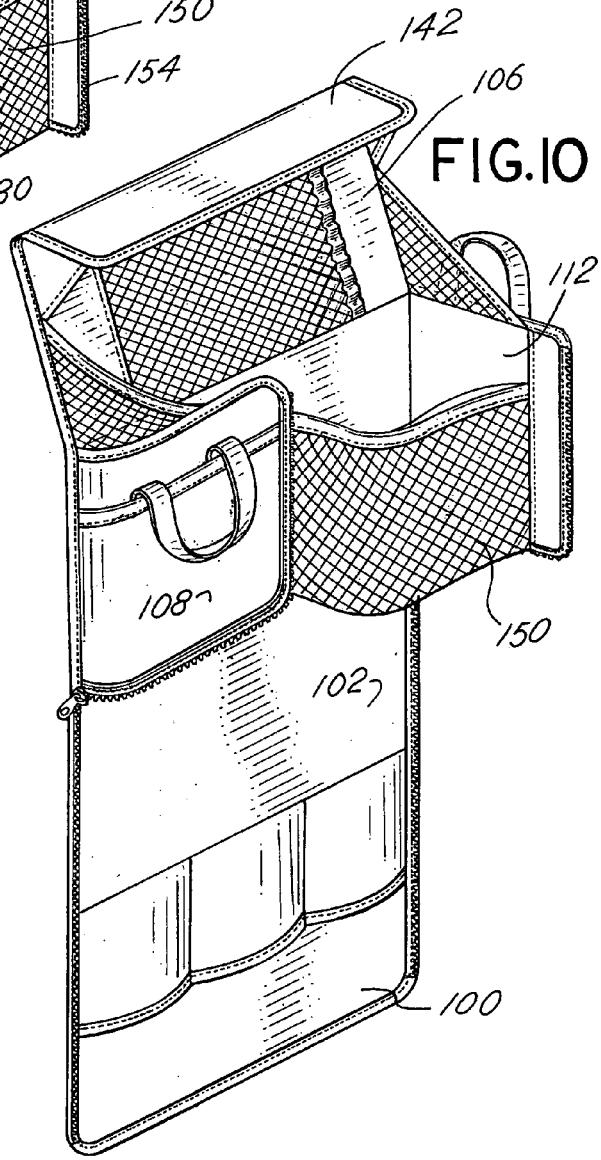
FIG. 10 is an isometric view of the open container of FIG. 9 wherein the fifth and sixth or end panels are illustrated as being folded over the third or back side rectangular panel thereby completing the process of fully collapsing the container.

A flexible wall or mesh panel 150 is provided between the fifth and sixth end panels 108 and 112. Preferably the flexible panel 150 is positioned adjacent the outer edges 152 and 154, respectively, of the end panels 108 and 112. The flexible panel 150 may be in the form of a single panel or it may be, as depicted in FIG. 10, in the form of a pocket for retaining various items within the enclosure defined by the container. Auxiliary storage pockets such as pockets 160 and 162 may be formed on the inside walls of the panels, for example panel 100, as depicted in FIG. 10. A flexible pocket 164 is provided in the top or fourth rectangular panel 106 again as depicted in FIG. 10. Consequently, numerous combinations of positioning and maintaining of pockets within the enclosure are possible.

Preferably handles are provided to facilitate movement of the container when filled or when collapsed. For example, outside handles 170 and 172 are provided for the sixth panel 112 and fifth panel 108, respectively, again as depicted in FIG. 10. A handle 176 is provided on the outside of the panels forming the container as depicted in FIG. 14 so that the collapsed container may be easily carried.

Figure 6:
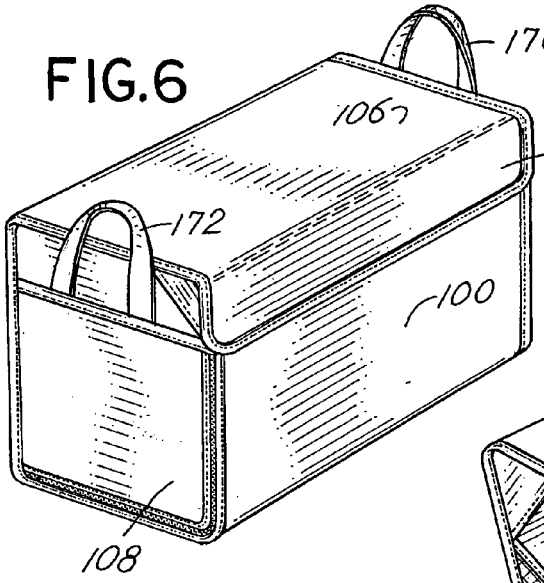
FIG. 6 is an isometric of the collapsible storage container of the invention.
Figure 7:
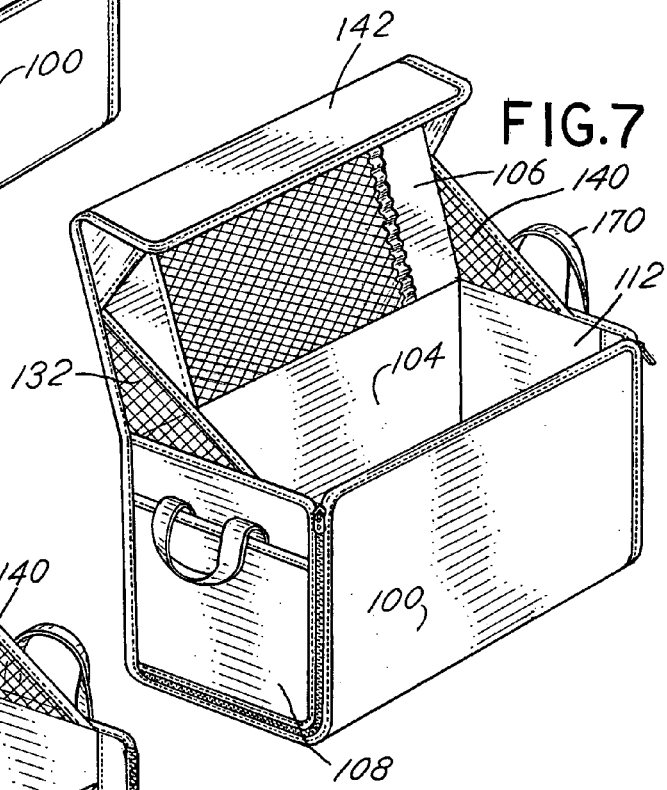
FIG. 7 is an isometric view of the container of FIG. 6 wherein the top panel has been opened.
Figure 8:
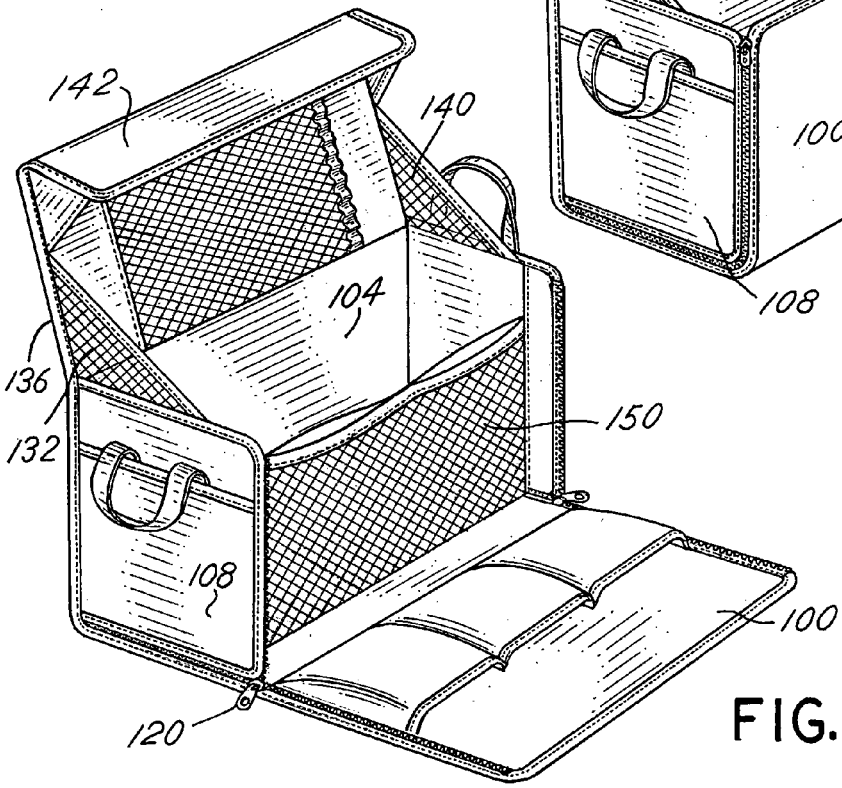
FIG. 8 is an isometric view of the container of FIG. 6 wherein the rectangular front side panel has been opened by release of zipper mechanisms.
Figure 9:
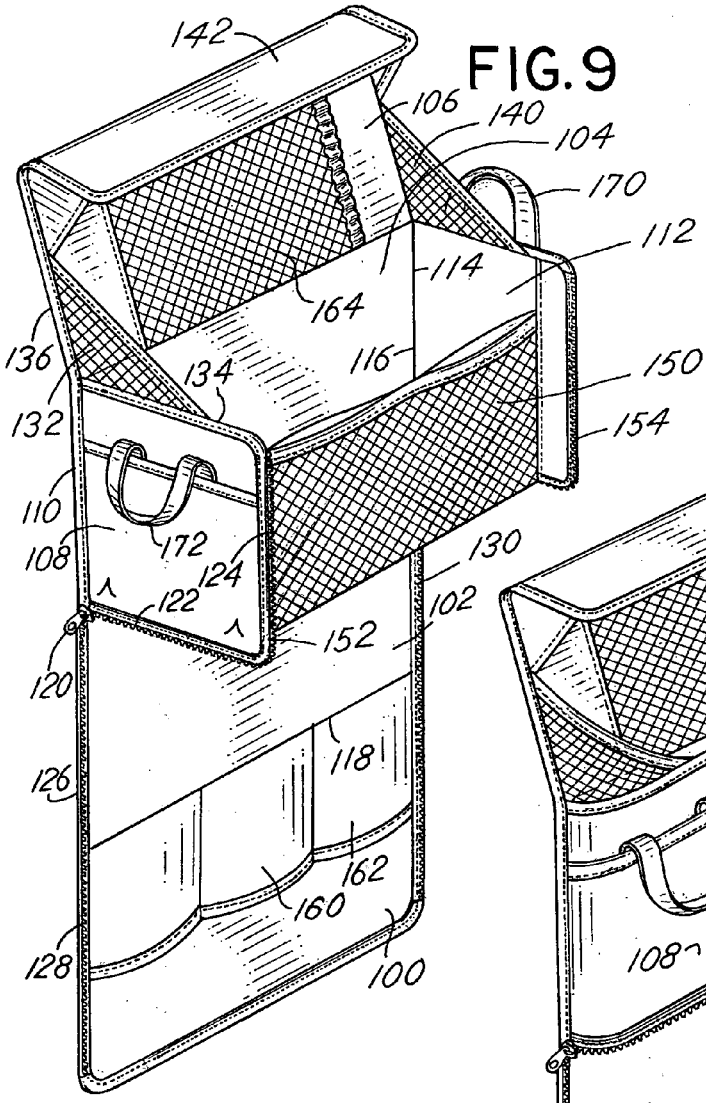
FIG. 9 is an isometric view of the container of FIG. 8 wherein the bottom or second rectangular panel has been detached from the fifth and sixth end panels or further opened so that the rectangular top, bottom, front and back side panels are in a planar or flat condition.

FIG. 6 depicts the collapsible container in the fully assembled condition. FIGS. 6 through 14 illustrate the sequential steps performed in converting the container from a fully assembled enclosure to a fully collapsed state as depicted in FIG. 14. The zipper connections or released first and fifth and sixth end panels 108, 112 are initially folded over the third side panel 104. The first and second panels 100, 102, 106 are then folded one over the other and then over the combined fifth, sixth, and third panels 108, 112, 104. The top or fourth panel 106 is then folded over the entire assembly and maintained in that condition by means of some type of fastener mechanism.

The preferred embodiment, all of the side panels, 100, 102, 104, and 106 are generally congruent in size and shape and are rectangular, though top panel 106 may be oversized. The end panels 108 and 112 are also preferably rectangular, however, adjustments may be made. Thus the rectangular configuration of the end panels may be altered to be, for example, four sided and perhaps trapezoidal thereby altering the length of the sides of the side panels. The container, however, remains generally in the form of a rectangular parallelepiped although perhaps skewed. Nonetheless, the assembly of the component sides is as described.

Thus it is possible to skew the shape of the panels somewhat without departing from the concept of utilizing six panels to form an enclosure wherein the sides are generally rigid or semi-rigid and connected by flexible hinges and foldable into a totally collapsed configuration.

Variations of the construction described are possible without departing from the spirit and scope of the invention. Some of those variations were set forth herein. Additional variations are possible to achieve the functionality described. The invention is, therefore, to be limited only by the following claims and equivalents thereof.

What is claimed is:

1. A collapsible storage container comprising, in combination:

first, second, third, and fourth rectangular panels joined seriatim together by flexible hinge connections and in the form of an array of four generally equally sized, flat panels that may be arranged seriatim in side to side serial order in a flat coplanar manner and (1) folded about the flexible hinge connections to form a four-sided, parallelepiped enclosure or (2) folded over one another, said first and third panels forming respectively opposed sides as an enclosure, and said second panel forming a bottom of an enclosure;

fifth and sixth generally rectangular, flat, end panels, each separate fifth and sixth panel, flexibly joined along one side edge to an opposite side edge of the third rectangular end panel, said fifth and sixth panels also connected together by a separate flexible connection panel; and a fastening mechanism to fasten the fifth and sixth end panels to the two adjacent first and second rectangular side panels along the side edges thereof to thereby form a five-sided, rectangular parallelepiped enclosure with the remaining fourth rectangular side panel foldable to form a top lid for the five-sided enclosure.

2. The container of claim 1 further including a fastening flap attached to the fourth rectangular side panel along a free edge thereof.

3. The container of claim 1 further including a flexible gusset connecting the fourth rectangular side panel side edges and the side edges of the fifth and sixth end panels, respectively.

4. The container of claim 1 wherein the flexible connection panel connects the fifth and sixth end panels to form a rectangular enclosure in combination with the third rectangular side panel.

5. The container of claim 1 further including handles on the end panels.

6. The container of claim 1 further including pockets in selected panels.

7. The container of claim 1 wherein the fastening mechanism comprises a zipper fastener.

8. The container of claim 1 further including a second fastening mechanism for maintaining the container in a collapsed condition with the fifth and sixth end panels folded against the third rectangular side panel, the first side panel folded over the second side panel, the combined first and second folded side panels folded over the fifth and sixth end panels and third side panel, and the fourth side panel folded over the combined folded first, second, third, fifth and sixth panels.

9. The container of claim 8 including a handle attached to the outside of a panel for carrying the collapsed container.

10. A collapsible storage container comprising, in combination:

first, second, third, and fourth rectangular panels joined seriatim together by flexible hinge connections and in the form of an array of four generally equally sized, flat panels that may be arranged in a flat coplanar manner and (1) folded about the flexible hinge connections to form a four-sided, parallelepiped enclosure or (2) folded over one another, said first and third panels forming respectively opposed sides as an enclosure, and said second panel forming a bottom of an enclosure;

fifth and sixth generally rectangular, flat, end panels, each separate fifth and sixth panel, flexibly joined along one side edge to an opposite side edge of the third rectangular end panel and connected together by a separate flexible connection panel;

a fastening mechanism to fasten the fifth and sixth end panels to the two adjacent first and second rectangular side panels along the side edges thereof to thereby form a five-sided, rectangular parallelepiped enclosure with the remaining fourth rectangular side panel foldable to form a top lid for the five-sided enclosure; and a flexible gusset connecting the fourth rectangular side panel side edges and the side edges of the fifth and sixth end panels, respectively.

11. The container of claim 10 further including a fastening flap attached to the fourth rectangular side panel along a free edge thereof.

12. The container of claim 10 wherein the flexible connection panel connects the fifth and sixth end panels to form a rectangular enclosure in combination with the third rectangular side panel.

13. The container of claim 10 further including handles on the end panels.

14. The container of claim 10 further including pockets in selected panels.

15. The container of claim 10 wherein the fastening mechanism comprises a zipper fastener.

16. The container of claim 10 further including a second fastening mechanism for maintaining the container in a collapsed condition with the fifth and sixth end panels folded against the third rectangular side panel, the first side panel folded over the second side panel, the combined first and second folded side panels folded over the fifth and sixth end panels and third side panel, and the fourth side panel folded over the combined folded first, second, third, fifth and sixth panels.

17. The container of claim 10 including a handle attached to the outside of a panel for carrying the collapsed container.

18. A collapsible storage container comprising, in combination:

first, second, third, and fourth rectangular panels joined seriatim together by flexible hinge connections and in the form of an array of four generally equally sized, flat panels that may be arranged in a flat coplanar manner and (1) folded about the flexible hinge connections to form a four-sided, parallelepiped enclosure or (2) folded over one another, said first and third panels forming respectively opposed sides as an enclosure, and said second panel forming a bottom of an enclosure;

fifth and sixth generally rectangular, flat, end panels, each separate fifth and sixth panel, flexibly joined along one side edge to an opposite side edge of the third rectangular end panel, said fifth and sixth end panels also connected together by a flexible connection panel to form a rectangular enclosure in combination with the third rectangular side panel; and a fastening mechanism to fasten the fifth and sixth end panels to the two adjacent first and second rectangular side panels along the side edges thereof to thereby form a five-sided, rectangular parallelepiped enclosure with the remaining fourth rectangular side panel foldable to form a top lid for the five-sided enclosure.

* * * * *